United States Patent [19]

Hansen

[11] Patent Number: 4,790,441

[45] Date of Patent: Dec. 13, 1988

[54] DISPLACEMENT APPARATUS

[76] Inventor: Anders B. N. Hansen, Mellby, S-312 00 Laholm, Sweden

[21] Appl. No.: 907,673

[22] Filed: Sep. 15, 1986

[51] Int. Cl.[4] ..... B66C 13/06

[52] U.S. Cl. ..... 212/147; 212/213; 414/917

[58] Field of Search ..... 212/146, 147, 187, 188, 212/199, 200, 201, 256, 260, 261, 262; 414/917; 187/18

[56] References Cited

U.S. PATENT DOCUMENTS

| | | | |
|---|---|---|---|
| 521,256 | 6/1894 | Browne | 414/917 |
| 2,500,815 | 3/1950 | Gerli et al. | 212/187 |
| 3,241,686 | 3/1966 | Hurst | 212/147 |
| 3,598,264 | 8/1971 | Massie | 414/917 |
| 3,995,746 | 12/1976 | Usagida | 414/917 |
| 4,548,544 | 10/1985 | Van Appledorn | 414/917 |
| 4,660,711 | 4/1987 | Alonso et al. | 414/917 |

FOREIGN PATENT DOCUMENTS

| | | | |
|---|---|---|---|
| 716965 | 2/1980 | U.S.S.R. | 212/147 |
| 1161372 | 6/1985 | U.S.S.R. | 414/917 |

*Primary Examiner*—Sherman D. Basinger
*Assistant Examiner*—Thomas J. Brahan
*Attorney, Agent, or Firm*—Roberts, Spiecens & Cohen

[57] ABSTRACT

An apparatus for the displacement of articles between positions located substantially in a common plane which includes a first carrier member (4) and a second carrier member (5) which are pivotally interconnected to one another by a plate (7) in immediate association with the one end (40, 50) of each respective carrier member. The first carrier member (4) is, in immediate association with its other end (41) movably journaled in a suspension device (6), while the second carrier member (5) is provided, at its other end (51), with a connector piece (55). The connector piece is disposed for temporary reception and/or retention of an article and delivery, respectively, of the article after displacement to the intended position. A drive mechanism is connected, by a transmission (3), to the connector piece (55) for regulating the distance between the connector piece and the suspension device (6). In the plate (7), the support members are interconnected by couplings (42, 52) which positively guide the carrier arms for concordant pivotal movement upon alteration of the distance between the connector piece (55) and the suspension device (6). As a result, there will always be obtained a linear movement for the connector piece (55) on its displacmeent in relation to the suspension device.

15 Claims, 3 Drawing Sheets

DISPLACEMENT APPARATUS

FIELD OF THE INVENTION

The present invention relates to an apparatus for displacing articles between positions located substantially in one plane common to the positions, the apparatus including a first and second carrier member rotatably interconnected in one journal in association with one end of each respective carrier member, and the second carrier member being, at its other end, provided with a connector piece for the temporary reception or retention of an article and for discharging thereof after displacement to the intended position, and more precisely relates to an apparatus in which the first carrier member is united, in conjunction with its other end, with a suspension device, and in which the carrier members are interconnected to one another by means of coupling members for the positive control of the carrier arms for their concordant rotation in the above-mentioned journal.

BACKGROUND

In many technical contexts, there is a need for displacement apparatus which collect articles from one position and move them to a new position, and in which the displacement takes place in one and the same plane (for example in a vertical plane). In such instances, the new position is often offset in both the vertical and the horizontal plane in relation to the collection position. In such physical applications, there is also a need for equipment which permits articles to be displaced substantially in one linear movement, for example in a vertical direction, in order to be removed from or deposited in spaces with restricted accessibility. Such needs exist, for instance, in operations in which articles are moved between mutually subsequently disposed baths for surface treatment (dip painting, galvanizing etc.). and also in many other fields of application in which, for example, packets, pallets or crates are stacked on or nested in one another.

It is previously known in this art to employ, for the above-outlined purposes, such equipment as overhead traveling cranes which run along a track and in which a lifting device may, using a cable, move up and down so as to realize the vertical displacement of the articles, while the horizontal displacement of the articles is brought about when the traveling crane moves along its track.

There are also similar solutions in which overhead traveling cranes with guide-steered lifting devices, sometimes also designated column traveling cranes, run along a track in a corresponding manner and the articles are moved along the track in the horizontal direction while the lifting device caters for the vertical displacement.

The above-described prior art solutions suffer from the drawback that, in certain of the embodiments, the articles, together with their lifting devices, may easily begin to swing pendulously in conjunction with their movement in the horizontal direction. In particular in articles of great mass, these problems are accentuated, since the moments of inertia and kinetic energies generated assume considerable proportions.

A drawback inherent in overhead traveling cranes with guide-steered lifting devices is that the columns are bulky and require considerable space, present obstruction when work is in operation and entail a risk for personal injuries, for example contusion injuries.

SUMMARY OF THE INVENTION

The object of the present invention is to realize an apparatus in which the above-outlined problems and drawbacks are obviated. According to the invention, an exact control of both the movement, or displacement, in the vertical direction and in the horizontal direction will be achieved without any tendencies to pendulous motion arising out of the kinetic energy generated in conjunction with the displacement operations, at the same time as the invention makes possible that the displacement of the articles in the vertical direction takes place linearly and without any simultaneous movement in the horizontal direction.

According to the invention, there is provided a first carrier member and a second carrier member which are pivotally interconnected in one journal in conjunction with the one end of each respective carrier member. The first carrier member is, at its other end, rotatably journaled in a suspension device and the second carrier member is, at its other end, provided with a connector piece for temporary reception and/or retention of an article and for discharge of the article after displacement to the intended position. As a rule, the connector piece is connected to the second carrier member by means of a bearing which permits rotational movement between the connector piece and the carrier member. The carrier members are caused, by drive means, to rotate about the journal which unites the carrier members to one another, the angle between the carrier members being altered. In association with the above-mentioned journal, the carrier members are interconnected by coupling means which positively guide the carrier arms to concordant rotation in the common journal. The lengths of the carrier members between the common journal and the journaling of each respective carrier member in the suspension device or in the connector piece mutually correspond. In the positively controlled concordant rotation, the connector thereby retains a position straight beneath the suspension device and the connector piece is moved linearly in the vertical direction. For displacement of the articles in the horizontal direction, the suspension device is connected to drive means with whose help the suspension device and, thereby, the carrier members are moved along a path or track. Naturally, in the normal case, these drive means consist of, for example, motors, hydraulic cylinders, pneumatic devices etc, but the invention per se is suitable for use also in purely manual operation.

In one preferred embodiment, the positively controlled concordant rotation is realized by means of gear wheels.

In a further preferred embodiment, the carrier members each comprise two arms of equal length between the journaling of each respective arm at the end regions thereof. In this instance, two of the arms have their journals located in the symmetric plane for the angle between the carrier members.

In still a further preferred embodiment, the connector piece is connected, by means of a transmission member, to the drive means for the relative movement of the carrier arms. In certain embodiments, the transmission means comprise, for example, a belt or a wire, while in other embodiments, the transmission means consists of, for example, a telescopic arm.

In yet a further embodiment, the first carrier member and the second carrier member comprise two pairwise and spaced-apart members which are each connected to one another by means of the suspension device and the connector piece. The box-like construction which is thereby created is particularly well-suited for use in appalications in which the apparatus is subjected to powerful mechanical stresses and/or in which a particularly high degree of accuracy and exactness is required in conjunction with collection and deposition of the articles. In order further to increase the degree of mechanical stability, the pairs of carrier members are, in certain physical applications, further united with one or some supplementary transverse connections. These are preferably located in immediate association with the journals where the carrier members are positively guided in concordant rotation. Moreover, a common shaft for the above-mentioned journals is often provided.

In the embodiment described in the foregoing paragraph, the suspension device is preferably provided in the form of a carriage which is displaced along one or more grooves which form the track along which the apparatus is moved. Normally, the track is disposed for displacement of the apparatus in the horizontal plane.

BRIEF DESCRIPTION OF THE FIGURES OF THE DRAWINGS

The nature of the present invention and its aspects will be more readily understood from the following brief description of the figures of the accompanying drawings, and discussion relating thereto.

In the accompanying drawings.

DETAILED DESCRIPTION OF PREFERRED EMBODIMENTS

Figure 1A:
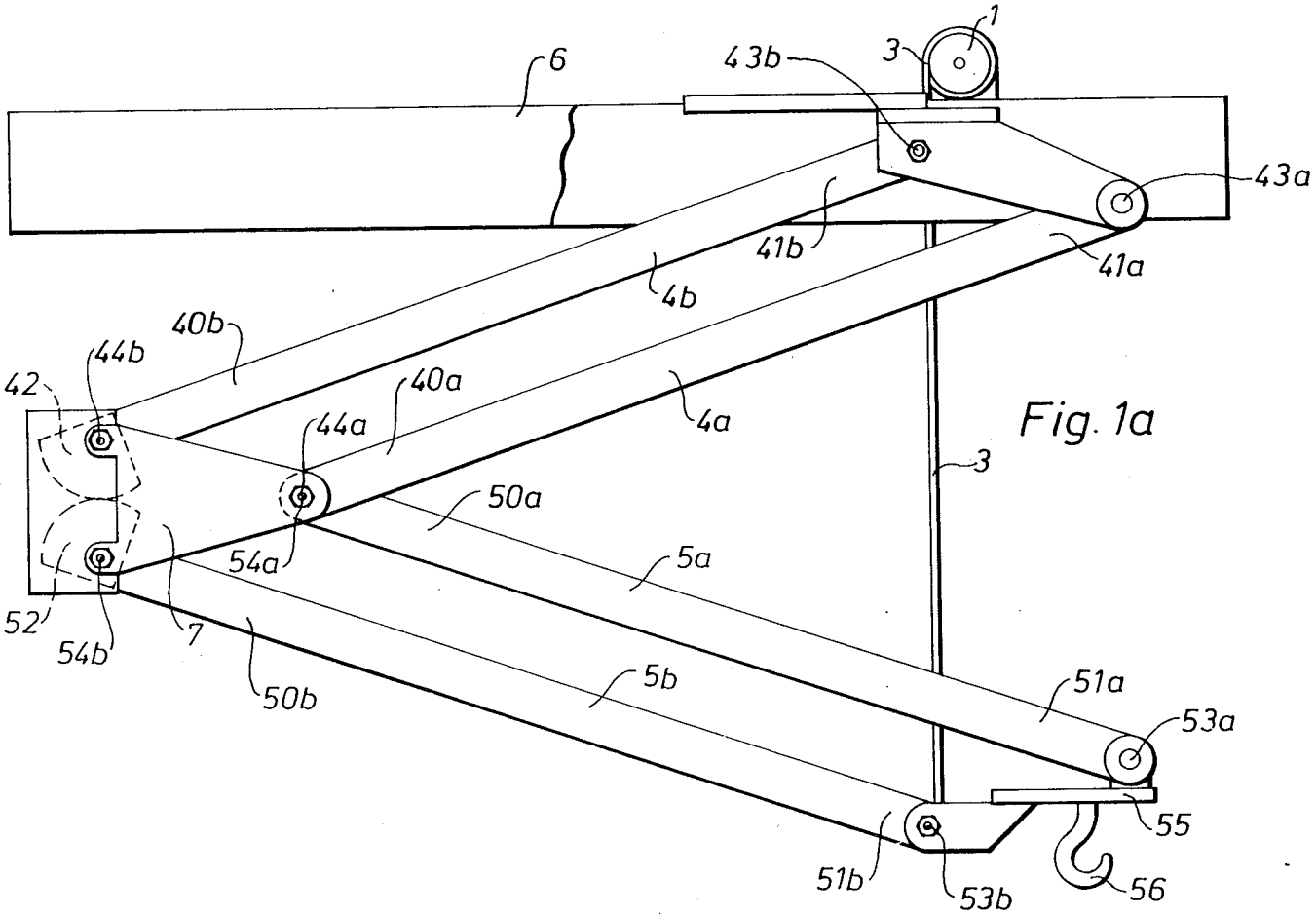
FIG. 1*a* shows the apparatus in side elevation view, partly broken away, in partly protracted state.
Figure 1B:
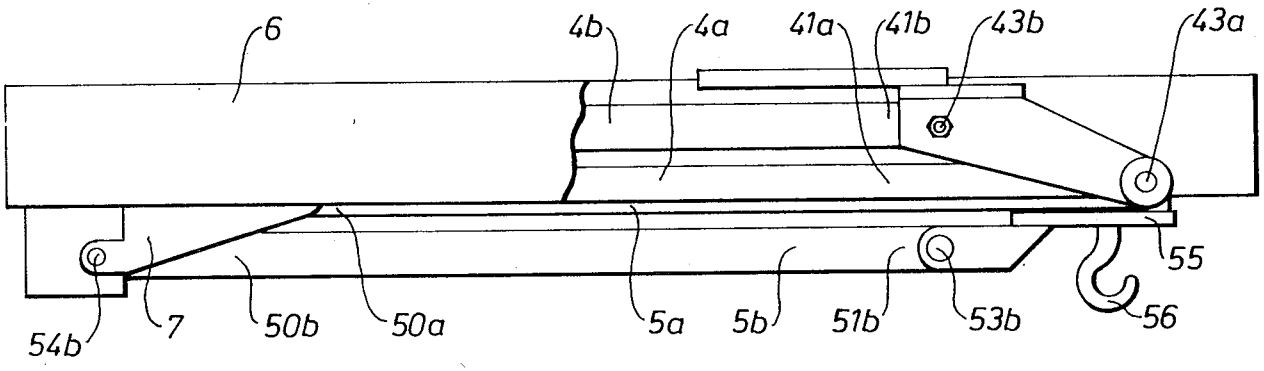
FIG. 1*b* shows the apparatus in the retracted state.

Refering to the drawings, one embodiment of an apparatus according to the present invention is shown in which embodiment a first carrier member 4*a,b* and a second carrier 5*a,b* are shown. The carrier members are interconnected with one another at their one ends 40*a,b;* 50*a,b,* by means of journals or hinges 44*a,b;* 54*a,b.* These are anchored in a plate 7 which constitutes a common journal or hinge for all carrier members. At its other end 41*a,b,* the first carrier member is connected to a suspension device 6 and is rotatably journaled therein by means of journals or hinges 43*a,b.* The second carrier member 5*a,b* is, at its other end 51*a,b* connected to a connector piece 55 and is rotatably journaled therein by means of journals or hinges 53*a,b.* The drawing also shows how a hook 56 is anchored to the connector piece 55. The hook shown in the drawing is depicted merely by way of example of a device for coupling of the articles to the connector piece 55. In other physical applications, use is made of, for example, grippers, brackets, forks, movable jaws etc to fix the articles in relation to the connector piece. As a rule, the articles are, in such an instance, given a predetermined orientation in relation to the connector piece.

In the illustrated embodiment, in which each one of the carrier members consists of the two arms 4*a,b* and 5*a,b,* respectively, two of these are provided with couplings 42, 52, which positively guide the carrier arms in concordant pivotal movement in the journals 44*b,* 54*b.* The couplings are preferably designed as gear wheels.

FIG. 1*a* also shows a drive means 1, for example an electric motor, with a drum about which a transmission device 3—in the figure depicted as a chain, belt or a wire—is wound. The transmission device is connected at its end to the connector piece 55, whereby the length of the transmission device from the drum of the drive means down to the connector piece determines the level thereof.

In certain embodiments, the tranmission device is designed as a telescopic arm which is united with the connector piece 55. The length of the telescopic arm is, for example, hydraulically or pneumatically variable for adjustment of the level of the connector piece.

Figure 2:
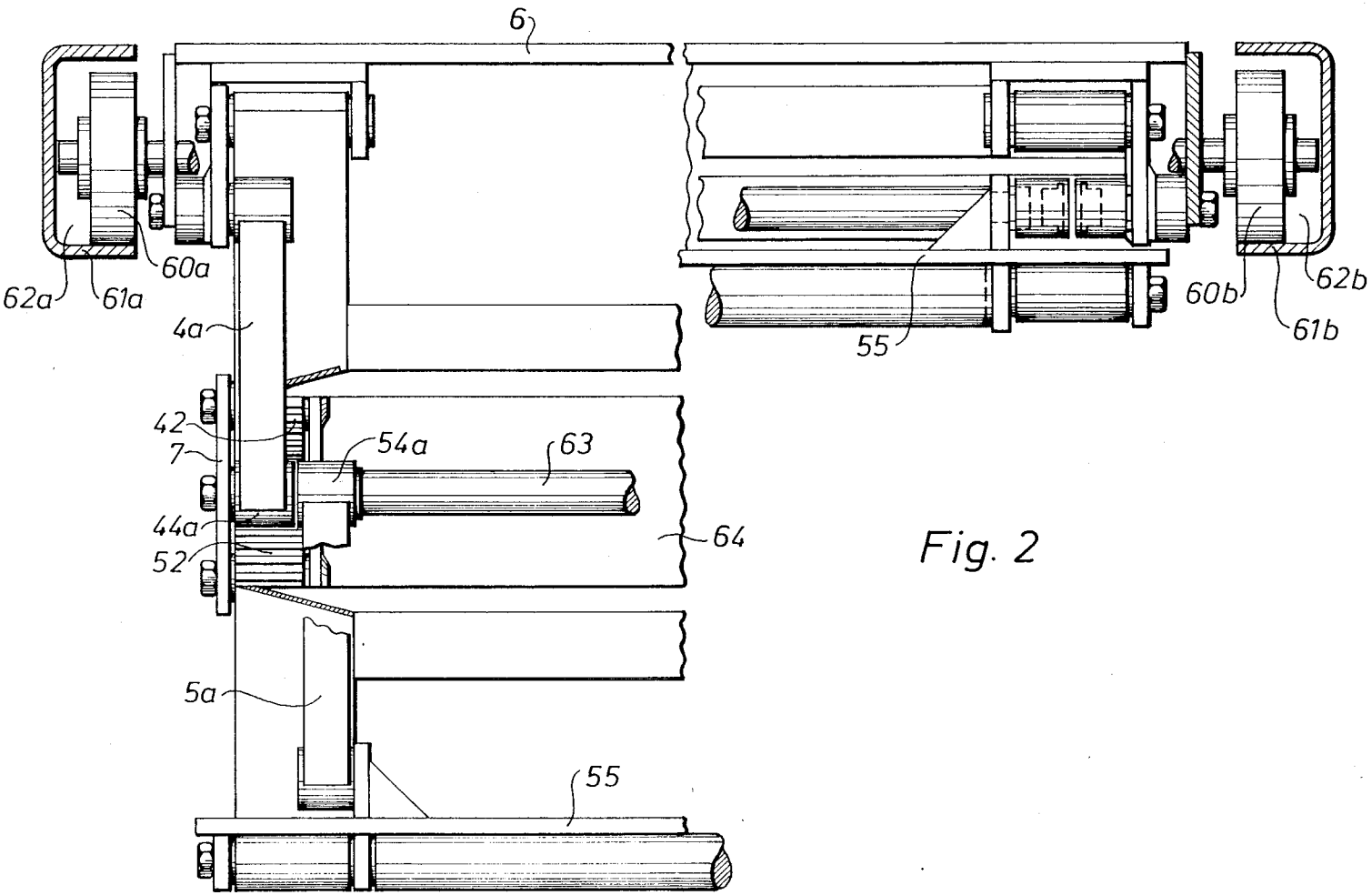
FIG. 2 shows the apparatus in front elevation, the left-hand half of the drawing showing the apparatus in the protracted state corresponding to that shown in FIG. 1 *a*, and the right hand half of the drawing showing the apparatus in the retracted state corresponding to that shown in FIG. 1*b*.

FIG. 2 illustrates in particular an embodiment of the present invention in which the first carrier member and the second carrier member each consist of two pairwise and spaced-apart members which are each interconnected to one another by means of the suspension device 6 and the connector piece 55. In this instance, the suspension device is preferably provided with wheels 60*a,b,* which run in a path 61*a,b,* provided with grooves 62*a,b.* The embodiment of the present invention shown in this drawing figure is also provided, in the region of the journals with transverse connections 63, 64 between the pairs of carrier members. One such connection is formed by, for example, a shaft 63 about which the journals 44*a,* 54*a* of the carrier arms are disposed. In other applications, the shaft is replaced by, or supplemented with (as shown on the drawing), a beam 64 connected to the master member formed by the journal and to which master member the journals of the carrier members 4*a,b;* 5*a,b* in the illustrated embodiment are connected.

When an apparatus to the present invention is put into use, the apparatus is moved to a position above the article which is to be collected. Using the drive means 1, the connector piece 55 is set at that position where the article is located and the article is fixed to the connector piece. The drive means subsequently displace the connector piece upwardly in the figure. The previously described positive guiding of the carrier members 4 and 5 respectively entails that the connector piece is displaced linearly in a vertical direction, at the same time as the journal is shifted in an arcuate motion. There will hereby be ensured exact control of the position of the article in relation to the suspension device 6 in a vertical plane through the suspension device. As a result of displacement in the horizontal direction of the suspension device, the article will be displaced to a position above that position to which it is to be moved, whereafter the connector piece 55 is moved to a position corresponding to that which constitutes the desired delivery position. The drive means here determines the position of the connector piece.

It will be apparent from the above description that the adjustment of the connector piece in both the vertical and the horizontal positions may be controlled in an extremely simple manner by the drive means, or alternatively by sensing means disposed in association with the drive means and/or the suspension device 6. In certain embodiments of the present invention, the movements of the drive means, and thereby the position of the connector piece 55, are determined by a host computation and control system, whereby the displacement by the apparatus of articles may be effected according to a given program adapted in accordance with the particular application contemplated in each individual case.

It will be further apparent from the above description that an apparatus according to the present invention is especially well suited for the precision displacement of articles between predetermined positions. In such applications where, for example, articles are to be progressively moved from one treatment station to the next, for example for surface treatment such as painting or galvanizing, an extremely reliable and simple apparatus will be obtained. Compared with prior art overhead traveling crane constructions, including such types as overhead traveling column cranes, the illustrated construction entails that generated acceleration and retardation forces are absorbed, at the same time as the risks of contusion injury linked with the operation of overhead traveling column crane constructions are eliminated.

In the above description, the disclosure as made herein has been related, to a certain extent, to the orientation depicted for the apparatus according to the present invention in the drawing figures. However, it will be obvious to a person skilled in this art that the apparatus per se may be employed, in certain of the above-disclosed embodiments, with any optional orientation thereof.

The present invention should not be considered as restricted to that described above and shown on the drawings, many modifications being conceivable without departing from the spirit and scope of the appended claims.

I claim:

1. Apparatus for the displacement of articles between positions located substantially in a vertical plane comprising first and second carrier members each including a pair of parallel arms having respective opposite ends, a plate, a first journal means rotatably connecting one of the ends of one of the arms of the first and second carrier members together to said plate for relative rotational movement about a common axis, second and third journal means connecting one of the ends of the other of the arms of the first and second carrier members to said plate for relative rotational movement, a suspension device, means pivotably connecting the other of the ends of the arms of the first carrier member to said suspension device, support means for an article to be displaced, means pivotably connecting the other of the ends of the second carrier member to said suspension device, drive means interconnecting said suspension device and said support means for displacing the same relative to one another in a vertical plane, gear wheels respectively coupled to said second and third journal means and to said one ends of said other arms of said first and second carrier members for undergoing rotation as said other arms undergo rotational movement relative to said plate, said gear wheels being in mesh with one another to provide concordant rotation of said other arms by said second and third journal means as said suspension device and said support means undergo relative displacement in a vertical plane whereby said plate moves in a vertical plane and said arms in said pairs remain parallel to one another, the arms in one pair forming an angle with the arms in the other pair, said arms being all of equal length.

2. Appartus as claimed in claim 1 wherein said drive means comprises a tension element.

3. Appartaus as claimed in claim 1 comprising a second assembly of additional first and second carrier members, plate, first, second, and third journal means, and gear wheels in horizontally spaced relation from the first assembly thereof, said suspension device and support means being connected to the first and second assemblies.

4. Apparatus as claimed in claim 3 comprising transverse connection means connecting said first and second assemblies together at said second and third journal means.

5. Apparatus as claimed in claim 4 wherein said transverse connection means comprises a transverse shaft on which the second and third journal means of the first and second assemblies are mounted.

6. Apparatus for displacement of an article between positions in a common plane comprising a suspension, first and second arms of substantially the same length, first and second spaced hinges respectively connecting said first and second arms to said suspension in parallel, spaced relation, a plate, third and fourth hinges respectively connecting said first and second arms to said plate, third and fourth arms of substantially the same length as said first and second arms, a fifth hinge connecting said third arm to said plate, said fourth arm being connected to said plate by said fourth hinge in common with said second arm so that said second and fourth arms are independently pivotable around said fourth hinge relative to said plate, a connector element, sixth and seventh spaced hinges respectively connecting said third and fourth arms to said connector element in parallel, spaced relation, support means on said connector element for suspension of a load thereon, and drive means interconnecting said suspension and said connector element for changing the distance therebetween, said arms undergoing pivotal movement around said hinges during change in said distance while said plate and said connector element undergo movement relative to said suspension, and coupling means connected to said third and fourth hinges for guiding pivotal movement of said first and third arms so that said connector element travels in a common plane when displaced relative to said suspension.

7. Apparatus as claimed in claim 6 wherein said coupling means comprises gear wheels in mesh with one another and driven by said third and fifth arms.

8. Apparatus as claimed in claim 7 wherein said third, fourth and fifth hinges are disposed on said plate at the corners of a triangle, the third and fifth hinges facing one another at the base of the triangle, the fourth hinge being at the vertex of the triangle.

9. Apparatus as claimed in claim 8 wherein said fourth hinge is located closer to said hinge on the suspension and on said connector element that are said third and fifthe hinges.

10. Apparatus as claimed in claim 8 wherein said connector element has opposite ends to which said sixth and seventh hinges are connected.

11. Apparatus as claimed in claim 8 wherein said connector element extends laterally away from said third and fourth arms and has an open upper surface.

12. Apparatus as claimed in claim 7 wherein said four arms, said hinges, said plate and said gear wheels form a first assembly supporting said suspension and said connector element at one of the lateral sides thereof, a second said assembly supporting the suspension and connector element at the other of the lateral sides thereof, and means connecting said first and second assemblies for common movement.

13. Apparatus as claimed in claim 12 wherein said means connecting the first and second assemblies comprises a transverse connecting element connecting said assemblies together at the fourth hinges thereof.

14. Apparatus as claimed in claim 13 wherein said transverse connecting element comprises a shaft on which said fourth hinges are formed.

15. Apparatus as claimed in claim 6 wherein said drive means comprises a tension element.

* * * * *